US007274331B2

(12) United States Patent
Heiniger et al.

(10) Patent No.: US 7,274,331 B2
(45) Date of Patent: Sep. 25, 2007

(54) PHASE-SHIFTING SYSTEM USING A DISPLACEABLE DIELECTRIC AND PHASE ARRAY ANTENNA COMPRISING SUCH A PHASE-SHIFTING SYSTEM

(75) Inventors: Markus Heiniger, Herisau (CH); Eugen Spirig, Diepoldsau (CH)

(73) Assignee: Huber + Suhner AG, Herisau (CH)

( * ) Notice: Subject to any disclaimer, the term of this patent is extended or adjusted under 35 U.S.C. 154(b) by 0 days.

(21) Appl. No.: 10/502,413

(22) PCT Filed: Jan. 23, 2003

(86) PCT No.: PCT/CH03/00053

§ 371 (c)(1),
(2), (4) Date: Apr. 22, 2005

(87) PCT Pub. No.: WO03/063290

PCT Pub. Date: Jul. 31, 2003

(65) Prior Publication Data

US 2005/0174195 A1 Aug. 11, 2005

(30) Foreign Application Priority Data

Jan. 24, 2002 (CH) ..... 0112/02

(51) Int. Cl.
*H01Q 3/32* (2006.01)
*H01P 1/18* (2006.01)

(52) U.S. Cl. ..... 342/375; 333/161; 333/156

(58) Field of Classification Search ..... 333/161, 333/156; 342/372, 375
See application file for complete search history.

(56) References Cited

U.S. PATENT DOCUMENTS

| | | | |
|---|---|---|---|
| 3,656,179 | A | 4/1972 | De Loach |
| 5,440,318 | A | 8/1995 | Butland et al. |
| 5,798,675 | A | 8/1998 | Drach |
| 5,801,600 | A | 9/1998 | Butland et al. |
| 5,905,462 | A | 5/1999 | Hampel et al. |

(Continued)

FOREIGN PATENT DOCUMENTS

| | | |
|---|---|---|
| DE | 199 11 905 A1 | 10/1999 |
| JP | 2001203501 | 7/2001 |
| JP | 2001237603 | 8/2001 |

OTHER PUBLICATIONS

Mark A. Gouker and Lawrence J. Kushner; A Microstrip Phase-Trim Device Using a Dielectric Overlay; 8099 IEEE Transactions on Microwave Theories and Techniques; No. 11 pp. 2023-2026; (Nov. 1994).

*Primary Examiner*—Benny T. Lee
(74) *Attorney, Agent, or Firm*—The Webb Law Firm

(57) ABSTRACT

A phase-shifting system for electrically swiveling the direction of a beam of an antenna field includes several radiators with two planes of polarization. The phase-shifting system includes two jointly changeable phase shifters with microstrip lines associated therewith. The electrical length of each phase shifter can be changed by a dielectric which is slidable above the microstrip lines. Such a phase-shifting system offers a simplified design and added functional safety by arranging the microstrip lines of both phase shifters in parallel next to each other and by providing a common slidable dielectric in order to change the electrical length of the microstrip lines of both phase shifters.

19 Claims, 5 Drawing Sheets

U.S. PATENT DOCUMENTS

| | | | | |
|---|---|---|---|---|
| 5,949,303 | A | 9/1999 | Arvidsson et al. | |
| 6,198,458 | B1 | 3/2001 | Heinz et al. | |
| 6,310,585 | B1 | 10/2001 | Marino | |
| 6,441,700 | B2 * | 8/2002 | Xu | 333/161 |
| 6,987,488 | B1 * | 1/2006 | Chang et al. | 343/767 |
| 7,026,889 | B2 * | 4/2006 | Sledkov | 333/128 |

* cited by examiner

PHASE-SHIFTING SYSTEM USING A DISPLACEABLE DIELECTRIC AND PHASE ARRAY ANTENNA COMPRISING SUCH A PHASE-SHIFTING SYSTEM

BACKGROUND OF THE INVENTION

1. Field of the Invention

The present invention relates to the field of radiofrequency engineering. It relates to a phase shifter arrangement and an antenna array having such a phase shifter arrangement.

2. Description of Related Art

In mobile radio technology, antenna arrays or antennas, in which two or more individual radiators are arranged one behind the other in a mounting direction and are driven via a common supply network, have long been known for equipping the base stations. In order to be able to take better account of the different conditions at the location of the respective base station and of the interaction with other base stations, it has proved to be advantageous to provide the antennas with the possibility of a "down tilt". This may take place, in principle, by purely mechanical means by the antenna being designed such that it can be adjusted at the point at which it is fixed to the mast. One disadvantage of this is the fact that considerable complexity is required to adjust and alter such a mechanical down tilt and it is usually necessary to climb the mast for this purpose.

Several suggestions have therefore been made to carry out an "electrical down tilt" by, in the case of a fixed antenna, the individual radiators of the antenna or the antenna array being driven on different phases such that the radiation lobe formed by superimposing the phase-shifted arrays of individual radiators is tilted in a desired manner ("phased array"). Examples of such an electrical "down tilt" are disclosed in U.S. Pat. No. 6,198,458 or in U.S. Pat. No. 5,801,600 or in U.S. Pat. No. 5,905,462. Used here are special differential phase shifters (see also DE-A1-199 11 905 or U.S. Pat. No. 5,949,303) or other phase shifters which are arranged in the supply network of the antenna between the individual radiators and can be adjusted at the same time, for example, via a linkage by means of a motor drive (see also U.S. Pat. No. 5,798,675). The simple, electrically controllable adjustability in this case also provides the possibility of remote adjustment from a control center or the like ("remote tilt control").

Combinations of mechanical and electrical down tilts are likewise conceivable (U.S. Pat. No. 5,440,318).

In more recent mobile radio transmission methods having a high data transmission rate, as are known, for example, by the abbreviation UMTS, the transition is increasingly being made to using "dual polarized antennas" in order to be able to make use of the effect of "polarization diversity" in which multiple transmission of data is possible on radio waves having a different polarization for the purpose of increasing transmission reliability. The radiators in these antennas in this case each have two radiator elements for the two polarizations and are in the form of, for example, cruciform dipoles or correspondingly designed patch radiators.

The document U.S. Pat. No. 6,310,585 discloses an electrically controlled down tilt by means of phase shifters for the dual polarized antennas or antenna arrays. For this purpose, each of the two radiator elements of a radiator within the supply network has in each case one associated phase shifter (40 in FIG. 1; 440 in FIG. 3), in which, for example, a microstrip line is overlapped to a greater or lesser extent by a displaceable dielectric (column 3, lines 61-65; column 5, lines 1-18). Details on the phase shifters and the associated microstrip lines are not given in the document.

In U.S. Pat. No. 6,310,585, the phase shifters for all of the radiator elements of one polarization direction are rigidly coupled mechanically to one another by means of a first rod. The phase shifters for all of the radiator elements of the other polarization direction are likewise rigidly coupled to one another mechanically by means of a second rod. The two rods, for their part, are rigidly connected to one another by means of a central supporting device (415 in FIG. 3) and are driven by a pinion via a toothed rack. In addition, two or more flexible positioning elements (420 in FIG. 3) are provided which press the dielectric against the microstrip lines below.

Disadvantages of this known phase shifter arrangement are not only the complex displacement mechanism comprising a plurality of individual elements, but also the separate structure of the individual phase shifters which requires high accuracy on assembly and thus increased mounting complexity with, at the same time, increased susceptibility to faults.

SUMMARY OF THE INVENTION

The present invention is a phase shifter arrangement that avoids the disadvantages of the known phase shifter arrangements, such that the design is simplified and the desired functionality is reliably achieved, as well as an antenna array having such a phase shifter arrangement.

The invention includes arranging the microstrip lines of the two phase shifters parallel and next to one another, and providing a common, displaceable dielectric for the purpose of altering the electrical length of these microstrip lines of the two phase shifters. In this manner, only a single displaceable dielectric is required per radiator, and this may be used to automatically and synchronously adjust the electrical length for the two polarizations. There is thus also only a single row of dielectrics arranged one behind the other provided in the mounting direction of the antenna array, and this row of dielectrics may be displaced at the same time in a particularly simple manner by means of a single rod extending in the longitudinal direction.

In particular, the microstrip lines and the displaceable arrangement of the dielectric are designed such that the electrical length of the two parallel microstrip lines is altered to the same extent when the dielectric is displaced. This ensures that the radiation lobe always has the same orientation for the two polarizations.

In principle, it would also be conceivable to displace the dielectrics of the phase shifter arrangements transversely with respect to the mounting direction of the antenna array. However, particularly simple is the mechanical system whereby, according to a preferred refinement of the invention, the microstrip lines extend essentially along a longitudinal axis, and the dielectric can be displaced in the direction of the longitudinal axis.

The microstrip lines preferably each have at least one center piece which is completely overlapped by the displaceable dielectric in a first position and is left completely free in a second position. In this case, it is favorable for the setting characteristics if the microstrip lines in the center pieces run transversely with respect to the longitudinal direction and have a meandering structure, since the electrical length is thus altered to a greater extent per unit of the displacement path.

Already disclosed in U.S. Pat. No. 3,656,179 is a way of altering the associated characteristic impedance by displacing the dielectric in a bus strip arrangement. In order to reduce the degree of alteration to the characteristic impedance to a tolerable level, another refinement of the invention provides for two or more line sections running parallel in the longitudinal direction to be provided within the meandering structure, and for the microstrip lines to alter their strip width in the line sections running in the longitudinal direction.

The alteration to the strip width is preferably designed such that, when the dielectric is displaced from the second to the first position, the strip width of the overlapped line sections, starting from a minimum strip width, increases as the overlap increases up to a maximum strip width, in particular the strip width increasing linearly with the displacement path in the longitudinal direction.

Particularly advantageous variation of the characteristic impedance by an average value results when the minimum strip width is selected such that, when there is an overlap with the dielectric in the region of the minimum strip width, the same characteristic impedance of the microstrip lines is produced as in the region of the maximum strip width where there is no overlap with the dielectric. This type of alteration to the strip width is advantageous for each phase shifter which operates with the displacement of a dielectric above a microstrip line, and specifically independently of whether two or more phase shifters have a common dielectric or not.

In addition, adjusting pieces having a differing strip width can be arranged in the line sections running in the longitudinal direction for the purpose of adjusting the characteristic impedance.

The phase shifter arrangement according to the invention is simplified further if the microstrip lines of the two phase shifters are arranged and formed on a common printed circuit board. Together with the common, displaceable dielectric, there is thus a high degree of synchronization with, at the same time, a particularly simple design.

One possible refinement of the printed circuit board consists in the microstrip lines of the two phase shifters being designed to be mirror-symmetrical with respect to a center axis, running parallel to the longitudinal axis, of the printed circuit board.

In order for the displaceable dielectric to always be in a defined position relative to the microstrip lines below, it is advantageous if the microstrip lines of the two phase shifters and the common dielectric above are pressed flat against one another by means of a spring metal sheet.

A particularly uniform pressing action results when the spring metal sheet is arranged on the underside of the microstrip lines and is electrically insulated from the microstrip lines by means of an intermediate insulating plate, and if the spring metal sheet has a plurality of individual spring tongues distributed over its surface.

Provided for the drive of the phase shifter is preferably a slide which is guided displaceably in the longitudinal direction, can be actuated manually from the outside or using a motor, and is in engagement with the dielectric. This configuration is particularly simple and functionally reliable and has the advantage of retaining its position when the motor drive fails.

It has proven successful in practice to use a plate having a relative dielectric constant of approximately 10, in particular in the form of a glass fiber-reinforced, organoceramic laminate, as the dielectric.

A preferred refinement of the antenna array according to the invention is characterized in that two or more phase shifter arrangements which can be displaced at the same time are arranged one behind the other within the supply network, and in that connections are provided between and downstream of the phase shifter arrangements for the purpose of connecting the radiators.

Another preferred refinement is distinguished by the fact that radiators are arranged in the antenna array 2n+1 (n=1, 2, 3, . . . ), that 2n phase shifter arrangements are arranged one behind the other in the associated supply network, that the supply inputs are connected to the supply network between the n-th and the (n+1)-th phase shifter arrangement, and that all of the phase shifter arrangements can be actuated at the same time, the first n phase shifter arrangements operating in opposition to the second n phase shifter arrangements.

DESCRIPTION OF THE DRAWINGS

The invention will be explained in more detail below with reference to exemplary embodiments in connection with the drawing, in which.

DETAILED DESCRIPTION OF THE INVENTION

Figure 10:
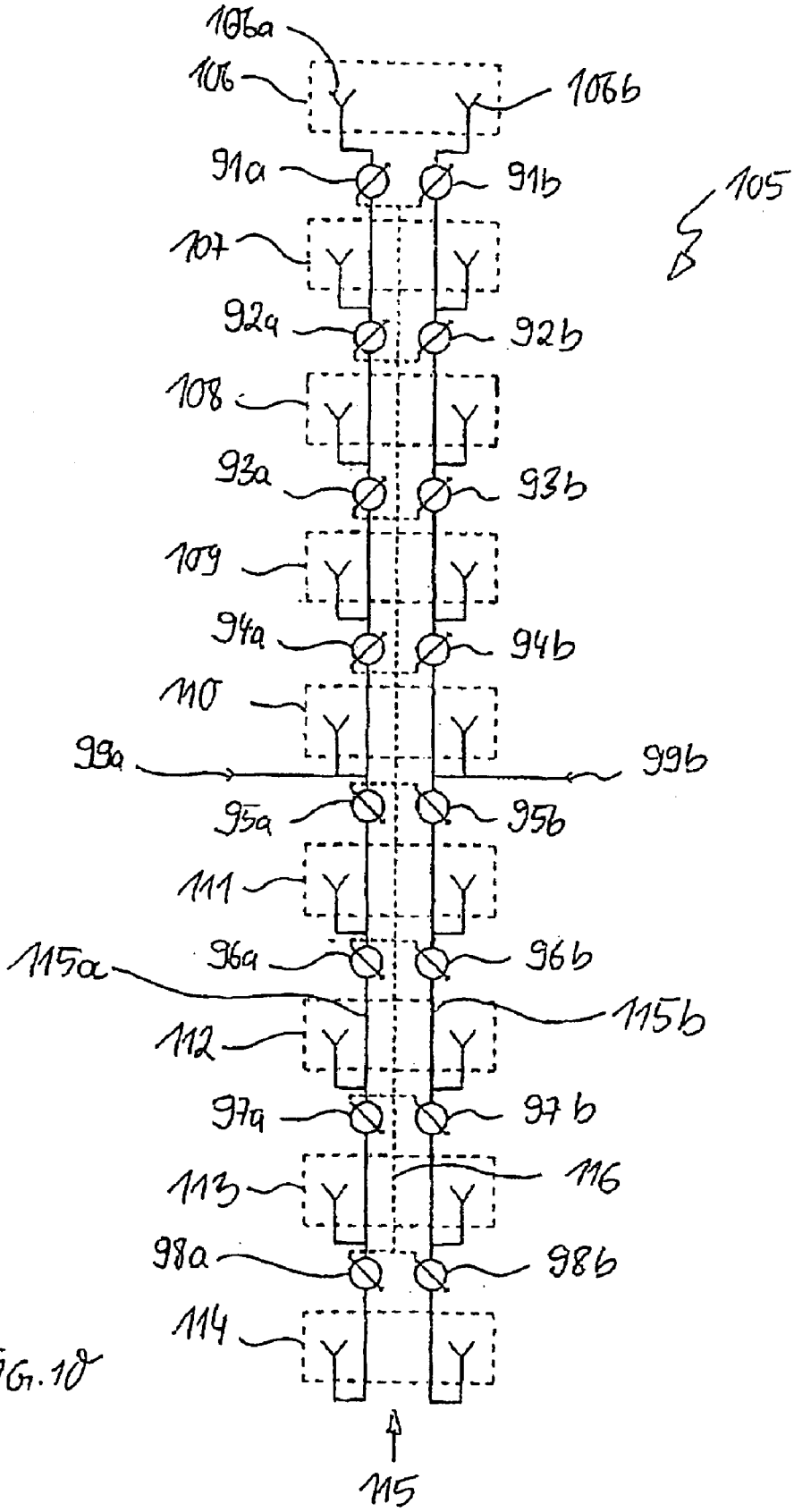
FIG. 10 shows the simplified circuit diagram for the antenna array shown in FIG. 9.

FIG. 10 shows the simplified circuit diagram of an antenna array 105, in which the present invention can advantageously be used. The antenna array comprises in total 9 radiators 106, . . . , 114, which are arranged one behind the other (one on top of the other) in a (vertical) mounting direction. Each of the radiators 106, . . . , 114 comprises two individual radiator elements 106*a, b* (the reference numerals for the radiator elements in the radiators 107, . . . , 114 are omitted for clarity). Each of the radiator elements 106*a, b* is associated with one polarization direction. The two polarization directions are generally at right angles to one another and usually form an angle of 45° with the mounting direction of the antenna array 105. The radiators 106, . . . , 114 are provided both for emitting and receiving radio waves.

The radiators 106, . . . , 114 or radiator elements 106*a, b* are connected, via a supply network 115, to two supply inputs 99*a, b*, which are arranged within the supply network 115 at the level of the central radiator 110. Each of the two supply inputs 99*a, b* is assigned one of the polarization directions and is connected to the corresponding radiator elements. In order for the radiators 106, . . . , 114 to be able to form a "phase array" and to emit and receive an electrically pivotable beam, phase shifters 91*a, b*, . . . , 98*a, b*, are arranged in pairs distributed in the supply network 115. Each pair of phase shifters 91*a, b*, . . . , 98*a, b* forms a phase shifter arrangement. The two phase shifters of a pair of phase shifters or of a phase shifter arrangement are adjusted in synchrony, as is illustrated in FIG. 10 by the dashed connecting lines within each pair. All of the phase shifter pairs 91*a, b*, . . . , 98*a, b* are actuated at the same time by a connecting tongue 116 running in the longitudinal direction (mounting direction), which is driven manually or using a motor and is likewise illustrated using dashed lines in FIG. 10. The change in the phase shift in the phase shifters 95*a, b*, . . . , 98*a, b* arranged below the supply inputs 99*a, b* takes place in this case in opposition to the change in the phase shift in the phase shifters 91*a, b*, . . . , 94*a, b* arranged above the supply inputs 99*a, b* (i.e. an increase in the phase shift at the bottom corresponds to a decrease in the phase shift at the top, and vice versa), which is indicated in FIG. 10 by the arrows in the phase shifters having a different orientation.

The central one of the 9 radiators 106, . . . , 114, namely the radiator 110, is connected directly to the supply inputs 99*a, b* and thus operates on a constant phase. The remaining 8 radiators 106, . . . , 109 and 111, . . . , 114 each have an associated phase shifter pair. Since the phase shifter pairs 91*a, b*, . . . , 98*a, b* are connected in series within the supply network 115, the individual phase shifts, starting from the center, are summed. If all of the phase shifters are the same, the phase shift toward the outside increases in equal increments: the signal supplied to the supply inputs 99*a, b* reaches the radiator 109 with a single phase shift, the radiator 108 with a dual phase shift, the radiator 107 with a triple phase shift, and the radiator 106 with a quadruple phase shift. The same applies for the radiators 111 to 114.

Figure 1:
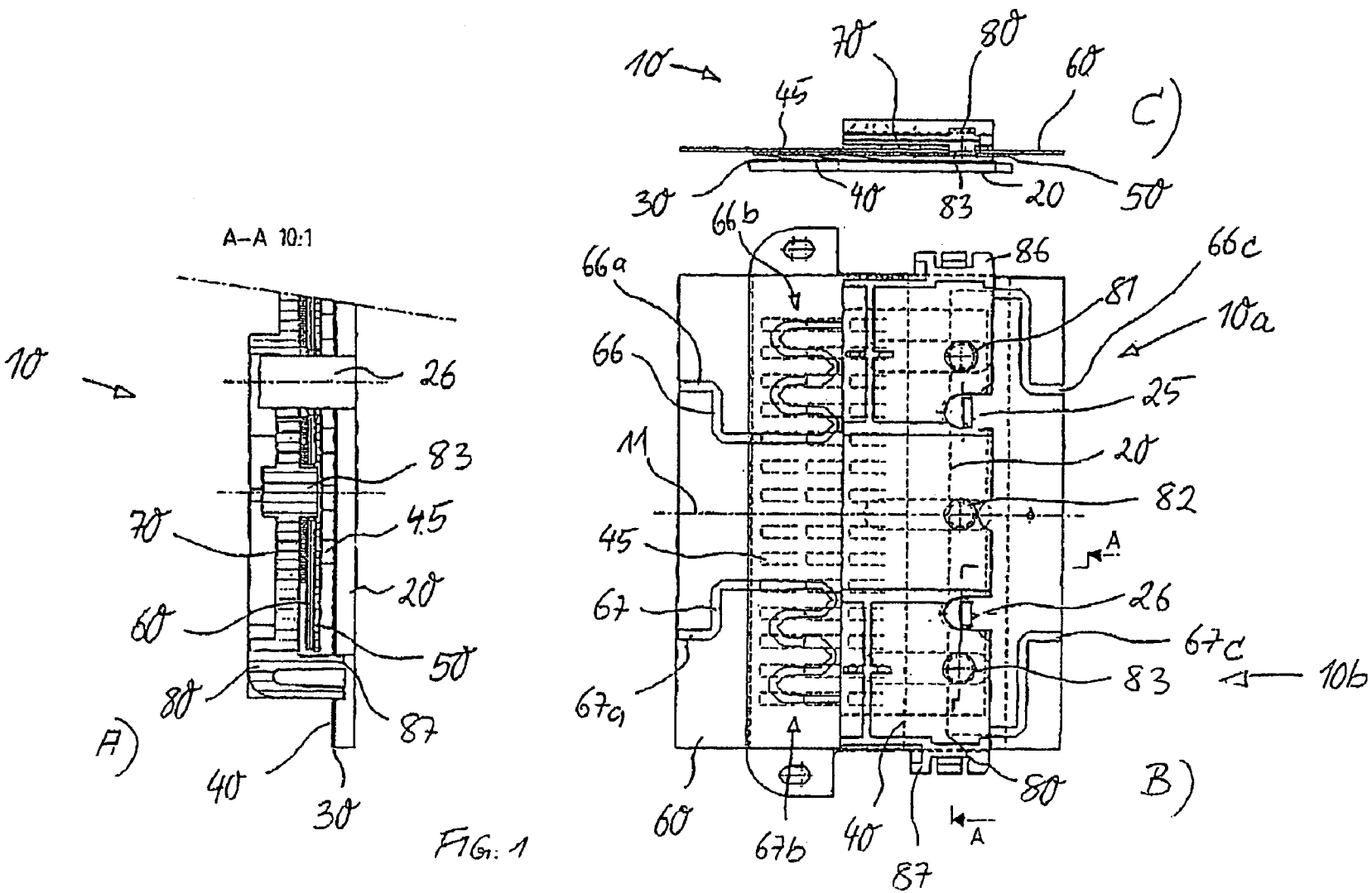
FIG. 1 shows a cross section (FIG. 1A), a plan view from above (FIG. 1B) and a longitudinal section (FIG. 1C) through an individual phase shifter arrangement comprising two phase shifters according to a preferred exemplary embodiment of the invention.
Figures 2, 3, 4, 5:
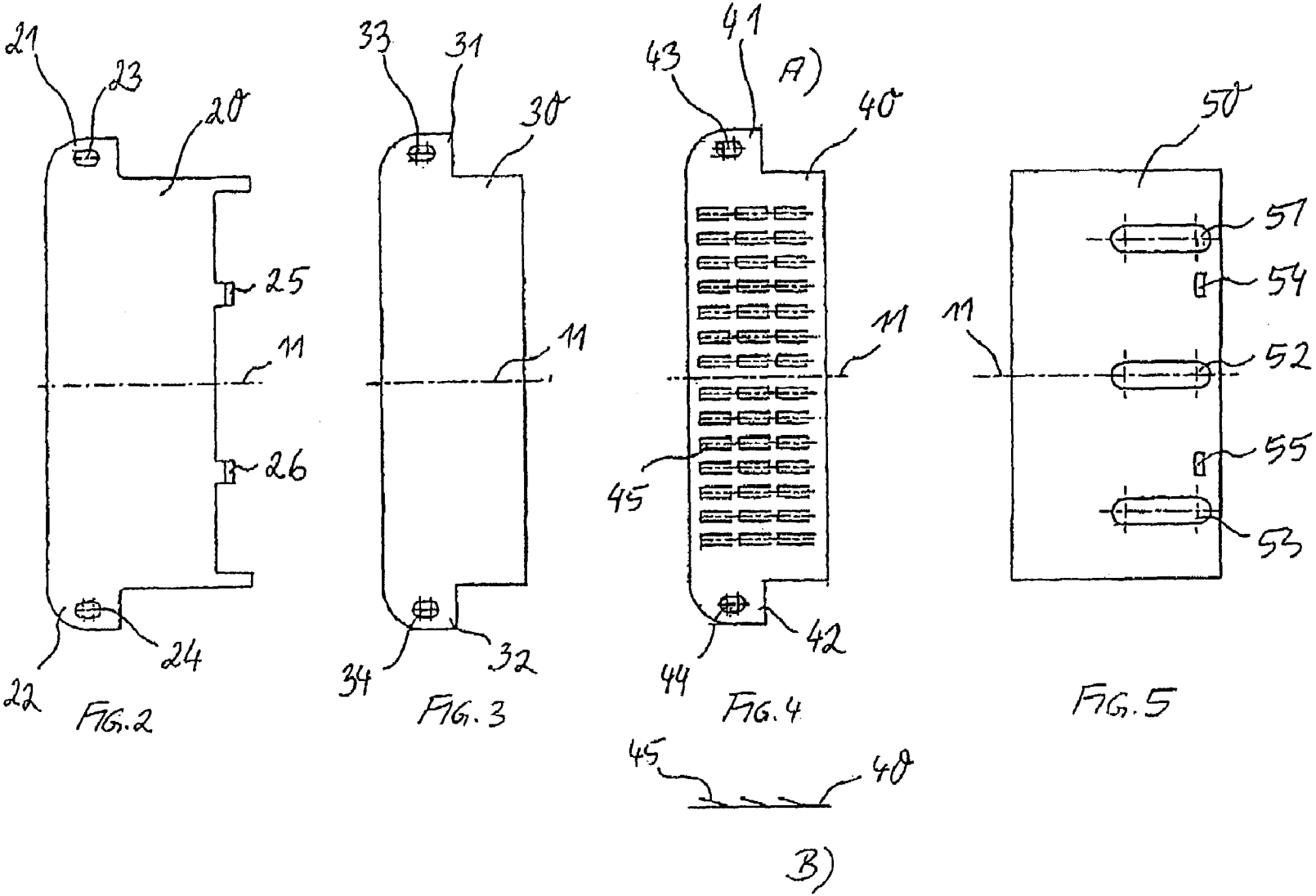
FIG. 2 shows the base plate of the phase shifter arrangement shown in FIG. 1.
FIG. 3 shows an insulating film of the phase shifter arrangement shown in FIG. 1.
FIG. 4 shows a plan view (FIG. 4A) and a side view (FIG. 4B) of the spring metal sheet of the phase shifter arrangement shown in FIG. 1.
FIG. 5 shows an insulating plate of the phase shifter arrangement shown in FIG. 1.

A single phase shifter pair or a single phase shifter arrangement now preferably has a construction as is shown in the exemplary embodiment in FIGS. 1 to 8, in which, in FIG. 1, different views are depicted of a completely assembled arrangement, whereas FIGS. 2 to 8 show the individual elements of the arrangement shown in FIG. 1 in sequence within the arrangement. The printed circuit board 60 shown in FIG. 6 and having the microstrip lines 66, 67 in this case only represents the subsection of a longer printed circuit board 90, as is reproduced in FIG. 9 for the entire antenna array 105 shown in FIG. 10.

The printed circuit board 60 (FIG. 6), which is made of, for example, a base material of 0.5 mm in thickness having a double-sided 35 μm Cu coating, has, on the underside, a continuous Cu coating and, on the top side, the conductor tracks shown which are mirror-symmetrical with respect to a center axis 11 and form the microstrip lines 66, 67. The printed circuit board 60 is arranged in the phase shifter arrangement 10 in FIG. 1 between a (lower) base plate 20 (FIG. 2) and an (upper) slide 80 (FIG. 8) such that the conductor tracks of the microstrip lines 66, 67 are on the side of the slide 80. The base plate 20, which may be in the form of, for example, an aluminum plate, has, on the sides, two fastening tabs 21, 22 having corresponding fastening holes 23, 24, by means of which it can be screwed tightly to an antenna housing.

Figure 8:
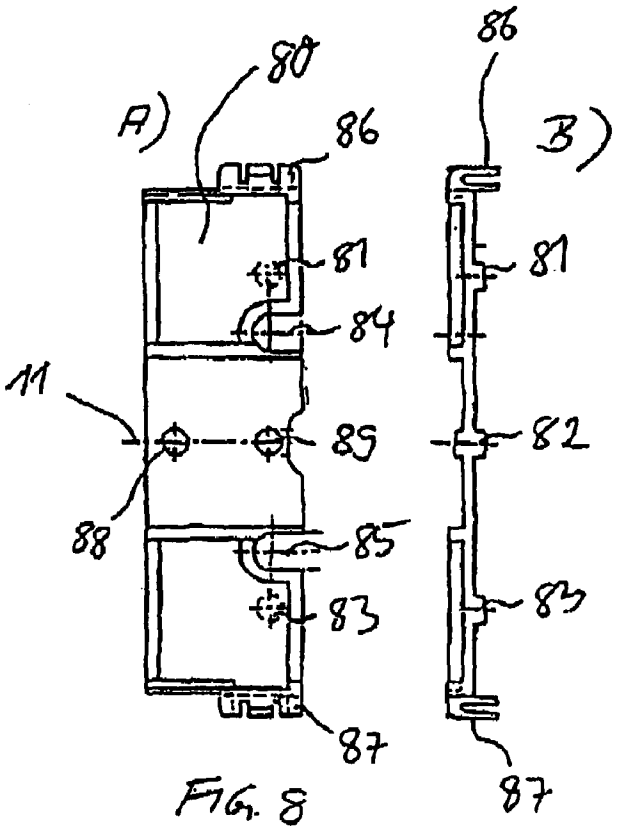
FIG. 8 shows a plan view from above (FIG. 8A) and a side view from the front (FIG. 8B) of the slide of the phase shifter arrangement shown in FIG. 1.
Figure 7:
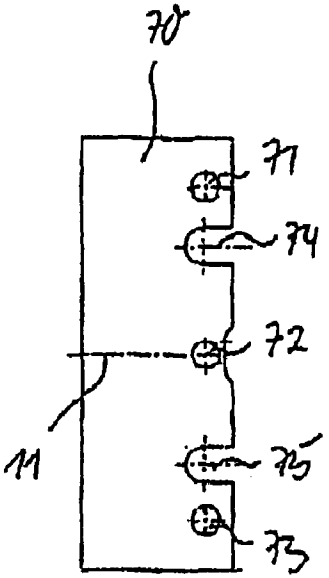
FIG. 7 shows the dielectric of the phase shifter arrangement shown in FIG. 1.
Figure 9:
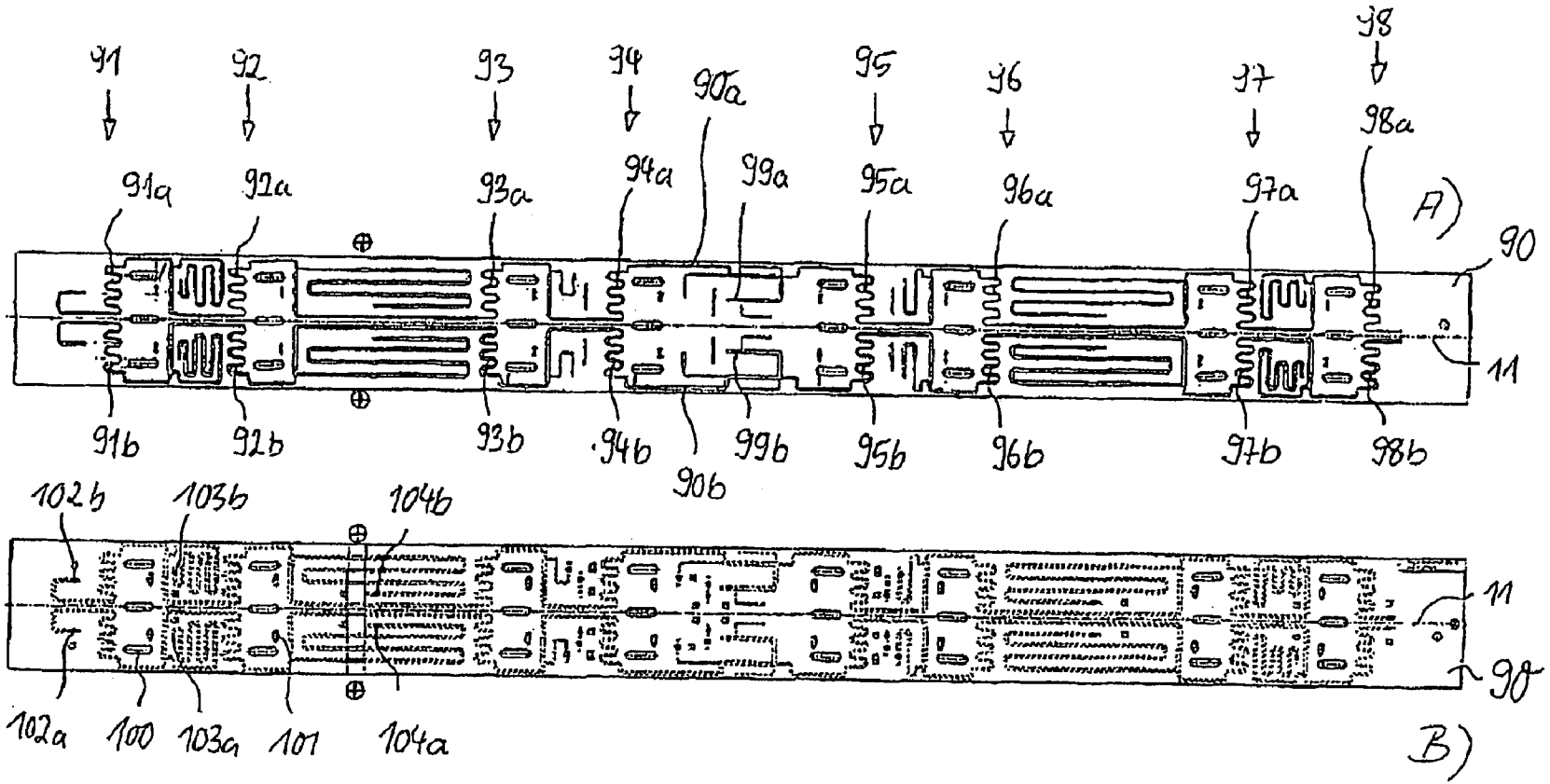
FIG. 9 shows the plan view of two sides (FIGS. 9A and B) of a printed circuit board having 8 phase shifter arrangements according to the invention for an antenna array having in total 9 radiators.

The printed circuit board 60 is fixed in relation to the base plate 20. This is achieved by two lugs 25, 26 which engage in corresponding openings 64, 65 in the printed circuit board 60 (FIG. 6) being bent back upward at right angles on the base plate 20. Also provided in the printed circuit board 60 are three guide openings 61, . . . , 63 in the form of slots which are spaced apart from one another, run parallel to the center axis 11, and in which the slide 80 engages with correspondingly formed and arranged engaging cams 81, . . . , 83 (FIG. 1; FIG. 8). The guide openings 61, . . . , 63 determine the displacement region of the slide 80 relative to the printed circuit board 60.

The slide 80, which may be made of, for example, plastic and may be an injection-molded part, also has two lateral guides 86, 87 which engage over the lateral edge of the printed circuit board 60. On its top side of the slide 80, integrally formed in a depression and one behind the other in the longitudinal direction, are two driver cams 88, 89 with which an actuating element (not shown) for the slide can engage. Furthermore, two recesses 84, 85 are provided on the slide 80 in order to provide space for the lugs 25, 26 protruding through the printed circuit board 60 from below.

The actual phase shifters 10*a*, 10*b* of the phase shifter arrangement 10 are formed by the interaction of the microstrip lines 66, 67 with a dielectric 70 arranged displaceably on the top side of the printed circuit board 60. The dielectric 70 shown in detail in FIG. 7 comprises, for example, an organoceramic laminate of the CER-10 type, as can be procured from the US company Taconic, Petersburgh, N.Y. (USA). The glass fiber-reinforced laminate filled with ceramic has a dielectric constant of 10 and very good mechanical properties. A plate of this material is used having a thickness of approximately 0.64 mm. Other dielectrics are also conceivable, however. According to FIG. 7, the dielectric 70 has three circular engaging openings 71, . . . , 73 which are spaced apart from one another and in which the slide 80 engages with its engaging cams 81, . . . , 83. The dielectric 70 is thus fixed in relation to the slide 80 and is displaced along with the slide 80. Furthermore, two recesses 74, 75 are provided in the dielectric 70 which are comparable in shape and function to the recesses 81, 82 of the slide 80.

Figure 6:
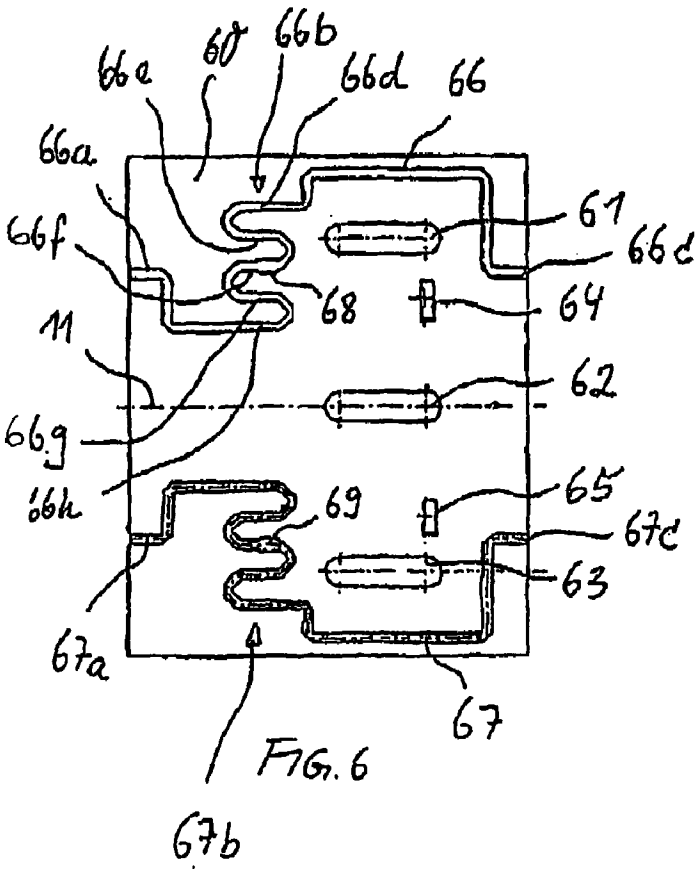
FIG. 6 shows the printed circuit board having the two microstrip lines of the phase shifter arrangement shown in FIG. 1.

The interaction of the microstrip lines 66, 67 and the dielectric 70 takes place essentially in the region of the meandering center pieces 66*b*, 67*b* of the microstrip lines 66, 67 which are each arranged between connection pieces 66*a, c* and 67*a, c* and run transversely with respect to the center axis 11 (FIG. 6). Each of the center pieces 66*b*, 67*b* comprises two or more (in the example in FIG. 6, 5) line sections 66*d* , . . . , *h*, which run parallel to the center axis 11 and are connected to one another for the purpose of forming the meandering pattern on alternating sides by means of U- or V-shaped bent pieces. Within the line sections 66*d*, . . . , *h*, the line width varies linearly with respect to the length and in the process decreases from left to right. Since the dielectric 70 with its left-hand edge moves when being displaced precisely in the region of the line sections 66*d*, . . . , *h*, when the dielectric is displaced, regions of the line sections 66*d*, . . . , *h* having different line widths are covered or not covered.

There is a particular reason for the variation in the line width of the line sections 66*d*, . . . , *h*: In order to maintain the (conventional) characteristic impedance of the microstrip lines 66, 67 of 50 ohms, the line width in the case of the materials and dimensions used is approximately 1.5 mm (without a dielectric on top). In the region of the dielectric on top, however, only a line width of approximately 0.98 mm is required for a characteristic impedance of 50 ohms owing to the dielectric. Therefore, if the line width outside the region of coverage of the dielectric is set at 1.5 mm and at 0.98 mm in the region of continuous coverage and a linear transition between these two extreme values is assumed in the intermediate line sections 66*d*, . . . , *h*, the deviation of the actual characteristic impedance when the dielectric 70 is displaced varies by the average value of 50 ohms, the characteristic impedance being more than 50 ohms if the dielectric 70 is shifted to the left far beyond the line sections 66*d*, . . . , h, and being less than 50 ohms if the dielectric 70 is shifted only slightly beyond the line sections 66*d*, . . . , *h*. Since only the absolute value of the difference is relevant for the (undesired) erroneous adjustment, and not the mathematical sign, a larger displacement region of the dielectric and thus a larger phase shift over a larger frequency range can thus be obtained utilizing the maximum permissible erroneous adjustment. In addition, it is possible for the electrical properties to be optimized by adjusting pieces 68, 69 being provided which are wider in the center pieces 66*b*, 67*b* (FIG. 6).

The two microstrip lines 66, 67 are (as can easily be seen in FIG. 6) formed and arranged such that they are mirror-symmetrical with respect to the center axis 11. The dielectric 70 is selected to be so wide that, in the event of a displacement in the direction of the center axis 11, the meandering center pieces 66*b*, 67*b* of the microstrip lines 66, 67 are overlapped or left free in the same manner. This makes it possible, without high complexity and with functional reliability to achieve synchronization between the two phase shifters 10*a* and 10*b* and to make the phase shifts in the two phase shifters 10*a, b* largely uniform.

However, an essential element ensuring functional reliability is the fact that the dielectric 70 bears tightly against the surface of the printed circuit board 60 carrying the microstrip lines 66, 67, if possible without an air gap. This is achieved by means of a flat spring metal sheet 40 (FIGS. 4A, B) which is arranged between the base plate 20 and the printed circuit board 60 and presses the printed circuit board 60 from below against the dielectric 70 held in the slide 80. The spring metal sheet 40 has (as does the base plate 20) lateral fastening tabs 41, 42 having corresponding fastening holes 43, 44 which are aligned with the fastening holes 23, 24 in the base plate 20. Arranged distributed over the surface of the spring metal sheet 40 is, next to one another, a large number of individual spring tongues 45 which have been produced, for example, from the spring metal sheet 40 by a stamping or bending process. The spring metal sheet 40 is electrically insulated from the base plate 20 by means of an intermediate, thin insulating film 30 (FIG. 3) which matches the base plate 20 and the spring metal sheet 40 in terms of the lateral fastening tabs 31, 32 and fastening holes 33, 34. The spring metal sheet 40 is furthermore electrically insulated with respect to the lower Cu layer of the printed circuit board 60 by means of an intermediate, for example 0.5 mm thick, insulating plate 50 (FIG. 5), against which the spring tongues 45 press. The insulating plate has openings 54, 55, through which the lugs 25, 26 of the base plate 20 pass through for fixing purposes. The slot-like guide openings 51, 53 are analogous to the guide openings 61, . . . , 63 in the printed circuit board 60 in terms of function and shape.

The exemplary embodiment shown in FIGS. 1 to 8 relates only to a phase shifter arrangement comprising two phase shifters 10*a*, 10*b* which is correspondingly only suitable for adjusting a dual polarized radiator. If, as is shown in FIG. 10, an antenna array 105 comprises more than two, for example 9, radiators 106, 107, 108, 109, 110, 111, 112, 113 and 114, and two or more, in the example, eight phase shifter arrangements are required for electrically pivoting the antenna beam, these phase shifter arrangements, together with the supply network 115, are preferably integrated on a single printed circuit board. Such a printed circuit board 90 for in total 9 radiators and 8 phase shifter arrangements is reproduced in FIG. 9. Formed on this printed circuit board 90 are, mirror-symmetrically with respect to the center axis 11, two microstrip lines 90*a*, 90*b* having branches which at the same time form a supply network with the power distributed over two or more antenna connections 102*a*, 102*b*, 103*a*, 103*b*, 104*a*, 104*b* (for simplicity only the antenna connections for 4 radiators are provided with reference numerals in FIG. 9B; in total there are antenna connections for 9 radiators or 18 radiator elements).

Formed within the supply network of the microstrip lines 90*a, b* are, in analogy to FIG. 6, meandering center pieces 91*a, b*, . . . , 98*a, b* which are each part of a phase shifter arrangement 91, . . . , 98 comprising two phase shifters. The supply inputs 99*a, b* are arranged in the center of the printed circuit board 90. Each of the phase shifter arrangements 91, . . . , 98 is assigned (in analogy to FIGS. 1 to 8) a dielectric which can be displaced by means of a slide, a base plate, and a spring metal sheet which is mounted such that it is insulated. Correspondingly, in each of the phase shifter arrangements 91, . . . , 98, guide openings 100 and openings 101 are provided for engagement of the base plate. The (nine) slides of all of the phase shifter arrangements 91, . . . , 98 are in engagement with a common actuating element (not shown) which extends along the center axis 11 over the entire printed circuit board 90 and can be displaced in the longitudinal direction manually from the outside or by means of a controlled motor drive.

In Summary the Following can be Said:

Phase shifters are required to achieve a variable down tilt in the case of an antenna array. It must be possible for the main lobe of the antenna to be lowered beyond the horizontal at least to a first zero position. In mobile radio engineering (GSM, UMTS), it is necessary to fulfill the following requirements:

In the case of large antennas, it must be possible to alter the down tilt between 0° and approximately 8°; for this purpose, it must be possible for the phase to be altered continuously between 0° and approximately 45° by means of the phase shifter.

In the case of small antennas, it must be possible to alter down tilt between 0° and approximately 16°; for this purpose, it must be possible for the phase to be altered continuously between 0° and approximately 85° by means of the phase shifter.

There are several possible ways of altering the phase. The following relationship applies between the electrical and the mechanical length of a line:

$$I_{elec}=I_{mech}\sqrt{\in_r}$$

The electrical length is proportional to the phase:

$$\varphi=\frac{I_{elec}}{\lambda}360°$$

In order to alter the phase, the mechanical length or the $\in_r$ can be altered.

A patent has already been applied for by the applicant for a phase shifter with means for altering the mechanical length of the line.

A phase alteration by altering the $\in_r$ can be achieved in the case of a microstrip line by a dielectric being laid on the line (see DE-A1-199 11 905).

According to the present solution, two or more line sections lying parallel and next to one another are connected to one another by a 180° corner to form a meandering structure. A dielectric having a high $\in_r$ is pushed over this line structure, a common dielectric being used for two adjacent phase shifters. The maximum possible phase shift is given by the number of line sections and their length which at the same time corresponds to the displacement path of the dielectric.

Using 5 parallel line sections, a phase shift of 46° is achieved; with 7 parallel line sections, a phase shift of 65° is achieved. In order to achieve an even greater phase shift, two or more phase shifters can be connected one behind the other.

By using an uneven number of line sections lying parallel and next to one another, the phase shifter can be integrated very effectively in a supply network. However, the phase shifter may also be realized using an even number of lines, which may be more advantageous for other applications.

Each individual line section in the phase shifter has a line width which can be altered linearly (is linearly tapered). In the 0° position of the phase shifter (the dielectric is not over the line sections), the line width is narrower and is of such a width that, together with the dielectric pushed on top of it, the system impedance (50Ω) is given. At the other end of the line sections, the line width corresponds to the normal microstrip. Despite the tapered line sections, depending on the position of the displaceable dielectric, there is an erroneous adjustment. Erroneous adjustment may be compensated for by small adjusting pieces ("stubs") in the line structure.

The phase shifter operates as follows: a base plate made of aluminum is screwed onto the antenna housing and positions, by means of two bent-back lugs, the printed circuit board having the line structure. The displaceable dielectric is located on the printed circuit board. Between the aluminum plate and the printed circuit board is a spring metal sheet which presses the printed circuit board against the dielectric. The printed circuit board (ground), the spring metal sheet and the aluminum plate are insulated from one another by additional insulators.

It is possible to use a substrate having a high $\in_r$ as the dielectric. This thin platelet is held by an additional plastic part (slide), which also has driver cams for the slide apparatus. It is also possible, by selecting a suitable plastic or a ceramic, for the dielectric platelet and the plastic part to be integral.

The phase may be set by means of a manually or electrically operated drive.

The invention claimed is:

1. A phase shifter arrangement for electrically pivoting the irradiation direction of an antenna array which includes two or more radiators having two polarization planes, the phase shifter arrangement comprising two phase shifters which can be altered at the same time, having associated microstrip lines whose electrical length can, in each case, be altered by means of a dielectric which is arranged such that it can be displaced over the microstrip lines, wherein:

the microstrip lines of the two phase shifters are arranged parallel and next to one another; and said displaceable dielectric is common to both said two phase shifters for the purpose of altering the electrical length of the microstrip lines of the two phase shifters in the same direction, wherein the microstrip lines extend essentially along a longitudinal axis, and said common displaceable dielectric is displaceable in the direction of the longitudinal axis.

2. The phase shifter arrangement of claim 1, wherein the microstrip lines and the displaceable arrangement of said common displaceable dielectric are configured such that the electrical length of the two parallel microstrip lines is altered to the same extent when the dielectric is displaced.

3. The phase shifter arrangement of claim 1, wherein a plate having a relative dielectric constant of approximately 10 is used as said common displaceable dielectric.

4. The phase shifter arrangement of claim 1, wherein the microstrip lines each has at least one center piece which is completely overlapped by said common displaceable dielectric in a first position and is left completely free in a second position.

5. The phase shifter arrangement of claim 4, wherein the microstrip lines in the center pieces run transversely with respect to the longitudinal direction and have a meandering structure.

6. The phase shifter arrangement of claim 5, wherein:

two or more line sections running parallel in the longitudinal direction are provided within the meandering structure; and the microstrip lines alter their strip width in the line sections running in the longitudinal direction.

7. The phase shifter arrangement of claim 6, wherein, when said common displaceable dielectric is displaced from the second to the first position, the strip width of the overlapped line sections, starting from a minimum strip width, increases as the overlap increases up to a maximum strip width.

8. The phase shifter arrangement of claim 7, wherein the strip width increases linearly with the displacement path in the longitudinal direction.

9. The phase shifter arrangement of claim 7, wherein the minimum strip width is selected such that, when there is an overlap with said common displaceable dielectric in the region of the minimum strip width, the same characteristic impedance of the microstrip lines is produced as in the region of the maximum strip width where there is no overlap with said common displaceable dielectric.

10. The phase shifter arrangement of claim 6, wherein adjusting pieces having a differing strip width are arranged in the line sections running in the longitudinal direction for adjusting the characteristic impedance.

11. The phase shifter arrangement of claim 1, wherein the microstrip lines of the two phase shifters are arranged and formed on a common printed circuit board.

12. The phase shifter arrangement of claim 11, wherein the microstrip lines of the two phase shifters are designed to be mirror-symmetrical with respect to a center axis that runs parallel to the longitudinal axis of the printed circuit board.

13. A phase shifter arrangement for electrically pivoting the irradiation direction of an antenna array which includes two or more radiators having two polarization planes, the phase shifter arrangement comprising two phase shifters which can be altered at the same time, having associated microstrip lines whose electrical length can, in each case, be altered by means of a dielectric which is arranged such that it can be displaced over the microstrip lines, wherein:

the microstrip lines of the two phase shifters are arranged parallel and next to one another; and said displaceable dielectric is common to both said two phase shifters for the purpose of altering the electrical length of the microstrip lines of the two phase shifters in the same direction, wherein the microstrip lines of the two phase shifters and said common displaceable dielectric above are pressed flat against one another by means of a spring metal sheet.

14. The phase shifter arrangement of claim 13, wherein:

the spring metal sheet is arranged on the underside of the microstrip lines and is electrically insulated from the microstrip lines by means of an intermediate insulating plate; and the spring metal sheet has a plurality of individual spring tongues distributed over its surface.

15. A phase shifter arrangement for electrically pivoting the irradiation direction of an antenna array which includes two or more radiators having two polarization planes, the phase shifter arrangement comprising two phase shifters which can be altered at the same time, having associated microstrip lines whose electrical length can, in each case, be altered by means of a dielectric which is arranged such that it can be displaced over the microstrip lines, wherein:

the microstrip lines of the two phase shifters are arranged parallel and next to one another; and said displaceable dielectric is common to both said two phase shifters for the purpose of altering the electrical length of the microstrip lines of the two phase shifters in the same direction, wherein a slide is provided which is guided displaceably in the longitudinal direction, which can be actuated manually from the outside or using a motor, and which is in engagement with said common displaceable dielectric.

16. An antenna array comprising:

a plurality of radiators which are arranged one behind the other in a longitudinal direction, each of which includes two radiator elements provided for different polarization planes, and which are connected to two supply inputs via a supply network that includes phase shifter arrangements, each phase shifter arrangement comprising two phase shifters which can be altered at the same time, having associated microstrip lines whose electrical length can in each case be altered by means of a dielectric which is arranged such that it can be displaced over the microstrip lines, wherein:

the microstrip lines of the two phase shifters are arranged parallel and next to one another; and said displaceable dielectric is common to both said two phase shifters for the purpose of altering the electrical length of the microstrip lines of the two phase shifters.

17. The antenna array of claim 16, wherein the supply network and the phase shifter arrangements are arranged on a common printed circuit board.

18. The antenna array of claim 16, wherein:

two or more phase shifter arrangements which can be displaced at the same time are arranged one behind the other within the supply network; and connections are provided between and downstream of the phase shifter arrangements for the purpose of connecting the radiator elements.

19. The antenna array of claim 18, wherein:

$2n+1(n=1, 2, 3, \ldots)$ radiator elements are arranged in the antenna array, 2n phase shifter arrangements are arranged one behind the other in the associated supply network; the supply inputs are connected to the supply network between the n-th and the (n+1)-th phase shifter arrangement; and all of the phase shifter arrangements can be actuated at the same time, the first n phase shifter arrangements operating in opposition to the second n phase shifter arrangements.

* * * * *

UNITED STATES PATENT AND TRADEMARK OFFICE

CERTIFICATE OF CORRECTION

PATENT NO. : 7,274,331 B2
APPLICATION NO. : 10/502413
DATED : September 25, 2007
INVENTOR(S) : Markus Heiniger et al.

It is certified that error appears in the above-identified patent and that said Letters Patent is hereby corrected as shown below:

Title page of the Patent: Item (54) and col. 1, line 1-4 "PHASE-SHIFTING SYSTEM USING A DISPLACEABLE DIELECTRIC AND PHASE ARRAY ANTENNA COMPRISING SUCH A PHASE-SHIFTING SYSTEM" should read
-- PHASE-SHIFTING SYSTEM AND ANTENNA FIELD COMPRISING SUCH A PHASE-SHIFTING SYSTEM --

Column 1, after line 12 and before "2. Description of Related Art", insert the following paragraph: -- Such a phase shifter arrangement or such an antenna array is disclosed, for example, in the document US-B1-6,310,585. --

Column 1, line 65, delete [[ (40 in FIG. 1; 440 in FIG.3) ]]

Column 1, line 67, bridging Column 1, line 1, delete [[ (column 3, lines 65-65; column 5, lines 1-18) ]]

Column 2, line 10, delete [[ (415 in FIG. 3)]]

Column 2, line 12, delete [[ (420 in FIG. 3)]]

Column 2, after the title, "SUMMARY OF THE INVENTION", delete the paragraph from lines 25-29 and insert therefor the following paragraph:
-- It is therefore the object of the invention to develop a phase shifter arrangement of the type mentioned initially such that the disadvantages of the known phase shifter arrangements are avoided, and such that, in particular, the design is simplified and the desired functionality is reliably achieved, as well as to specify an antenna array having such a phase shifter arrangement. --

Column 3, line 16, "Particularly" should read -- A particular --

Column 4, line 5, after "fact that" insert -- 2n+1 (n=1,2,2, . . .) --

Column 4, line 5, after "antenna array", delete [[2n+1 (n=1,2,2, . . .)]]

Column 4, after line 13 and before "DESCRIPTION OF THE DRAWINGS", insert the following paragraph: -- Further embodiments are described hereinafter. --

Column 4, lines 43-44, "(FIGS. 9A and B)" should read -- (FIGS. 9A and 9B) --

Column 4, line 56, "106, . . . , 114" should read -- 106, 107, 108, 109, 110, 111, 112, 113 and 114 --

UNITED STATES PATENT AND TRADEMARK OFFICE

CERTIFICATE OF CORRECTION

PATENT NO. : 7,274,331 B2
APPLICATION NO. : 10/502413
DATED : September 25, 2007
INVENTOR(S) : Markus Heiniger et al.

It is certified that error appears in the above-identified patent and that said Letters Patent is hereby corrected as shown below:

Column 4, line 58, “106, . . . , 114” should read -- 106, 107, 108, 109, 110, 111, 112, 113 and 114 --

Column 4, line 59, “106a, b” should read -- 106a, 106b --

Column 4, line 61, “107, . . . , 114” should read -- 107, 108, 109, 110, 111, 112, 113 and 114 --

Column 4, line 62, “106a, b” should read -- 106a, 106b --

Column 4, line 66, “106, . . . , 114” should read -- 106, 107, 108, 109, 110, 111, 112, 113 and 114 --

Column 5, line 1, “106, . . . , 114” should read -- 106, 107, 108, 109, 110, 111, 112, 113 and 114 --

Column 5, line 1, “106a, b” should read -- 106a, 106b --

Column 5, line 3, “99a, b” should read -- 99a, 99b --

Column 5, line 5, “99a, b” should read -- 99a, 99b --

Column 5, line 7, “106, . . . , 114” should read -- 106, 107, 108, 109, 110, 111, 112, 113 and 114 --

Column 5, line 9, “91a, b, . . . , 98a, b” should read -- 91a, 91b, 92a, 92b, 93a, 93b, 94a, 94b, 95a, 95b, 96a, 96b, 97a, 97b, 98a, 98b --

Column 5, line 11, “91a, b, . . . , 98a, b” should read -- 91a, 91b, 92a, 92b, 93a, 93b, 94a, 94b, 95a, 95b, 96a, 96b, 97a, 97b, 98a, 98b --

Column 5, line 16, “91a, b, . . . , 98a, b” should read -- 91a, 91b, 92a, 92b, 93a, 93b, 94a, 94b, 95a, 95b, 96a, 96b, 97a, 97b, 98a, 98b --

Column 5, lines 20-21, “91a, b, . . . , 98a, b” should read -- 91a, 91b, 92a, 92b, 93a, 93b, 94a, 94b, 95a, 95b, 96a, 96b, 97a, 97b, 98a, 98b --

Column 5, line 21, “99a, b” should read -- 99a, 99b --

UNITED STATES PATENT AND TRADEMARK OFFICE

CERTIFICATE OF CORRECTION

PATENT NO. : 7,274,331 B2
APPLICATION NO. : 10/502413
DATED : September 25, 2007
INVENTOR(S) : Markus Heiniger et al.

It is certified that error appears in the above-identified patent and that said Letters Patent is hereby corrected as shown below:

Column 5, line 23, "91a, b, . . . , 94a, b" should read -- 91a, 91b, 92a, 92b, 93a, 93b, 94a, 94b --

Column 5, line 24, "99a, b" should read -- 99a, 99b --

Column 5, line 30, "99a, b" should read -- 99a, 99b --

Column 5, line 31, "106, . . . , 109 and 111, . . . , 114" should read -- 106, 107, 108, 109, and 111, 112, 113 and 114 --

Column 5, line 33, "91a, b, . . . , 98a, b" should read -- 91a, 91b, 92a, 92b, 93a, 93b, 94a, 94b, 95a, 95b, 96a, 96b, 97a, 97b, 98a, 98b --

Column 5, line 37, "99a, b" should read -- 99a, 99b --

Column 5, line 65, after "21, 22", insert -- (FIG. 2) --

Column 6, line 2, after "25, 26", insert -- (FIG. 2) --

Column 6, line 6, "61, . . . , 63" should read -- 61, 62, 63 --

Column 6, line 10, "81, . . . , 83" should read -- 81, 82, 83 --

Column 6, lines 10-11, "61, . . . , 63" should read -- 61, 62, 63 --

Column 6, line 13, after "slide 80" insert -- (FIG. 8) --

Column 6, line 16, after "slide 80" insert -- (FIG. 8) --

Column 6, line 21, after "lugs 25, 26" insert -- (FIG. 2) --

Column 6, line 35, "71, . . . , 73" should read -- 71, 72, 73 --

Column 6, line 37, "81, . . . , 83" should read -- 81, 82, 83 --

Column 6, line 41, "recesses 81, 82" should read -- recesses 84, 85 --

Column 6, line 47, "66a, c and 67a, c" should read -- 66a, 66c and 67a, 67c --

Column 6, line 49, "in FIG. 6, 5" should read -- in FIG. 6 --

UNITED STATES PATENT AND TRADEMARK OFFICE

CERTIFICATE OF CORRECTION

PATENT NO. : 7,274,331 B2
APPLICATION NO. : 10/502413
DATED : September 25, 2007
INVENTOR(S) : Markus Heiniger et al.

It is certified that error appears in the above-identified patent and that said Letters Patent is hereby corrected as shown below:

Column 6, line 50, “66d , . . . , h” should read -- 66d, 66e, 66f, 66g, 66h --

Column 6, line 54, “66d , . . . , h” should read -- 66d, 66e, 66f, 66g, 66h --

Column 6, line 58, “66d , . . . , h” should read -- 66d, 66e, 66f, 66g, 66h --

Column 6, line 59, “66d , . . . , h” should read -- 66d, 66e, 66f, 66g, 66h --

Column 6, line 62, “66d , . . . , h” should read -- 66d, 66e, 66f, 66g, 66h --

Column 7, line 6, “66d, . . . , h” should read -- 66d, 66e, 66f, 66g, 66h --

Column 7, line 11, “66d, . . . , h” should read -- 66d, 66e, 66f, 66g, 66h --

Column 7, line 12, “66d, . . . , h” should read -- 66d, 66e, 66f, 66g, 66h --

Column 7, line 32, “10a, b” should read -- 10a, 10b --

Column 7, line 38, “4A, B” should read -- 4A, 4B --

Column 7, lines 59-60, “51, 53” should read -- 51, 52, 53 --

Column 7, line 60, “61, . . . , 63” should read -- 61, 62, 63 --

Column 8, line 17, “90a, b” should read -- 90a, 90b --

Column 8, line 18, “91a, b, . . . , 98a, b” should read -- 91a, 91b, 92a, 92b, 93a, 93b, 94a, 94b, 95a, 95b, 96a, 96b, 97a, 97b, 98a, 98b --

Column 8, line 19, “91, . . . , 98” should read -- 91, 92, 93, 94, 95, 96, 97, 98 --

Column 8, line 20, “99a, b” should read -- 99a, 99b --

Column 8, line 22, “91, . . . , 98” should read -- 91, 92, 93, 94, 95, 96, 97, 98 --

Column 8, line 27, “91, . . . , 98” should read -- 91, 92, 93, 94, 95, 96, 97, 98 --

Column 8, line 29, “91, . . . , 98” should read -- 91, 92, 93, 94, 95, 96, 97, 98 --

Column 8, line 53, “the electrical” should read -- the electrical length (Ielec ) --

UNITED STATES PATENT AND TRADEMARK OFFICE

CERTIFICATE OF CORRECTION

PATENT NO. : 7,274,331 B2
APPLICATION NO. : 10/502413
DATED : September 25, 2007
INVENTOR(S) : Markus Heiniger et al.

It is certified that error appears in the above-identified patent and that said Letters Patent is hereby corrected as shown below:

Column 8, line 54, "the mechanical length" should read -- the mechanical length (Imech) --

Column 8, line 55, "the electrical length is proportional to the phase:" should read -- the electric length (Ielec ) is proportional to the phase (Φ): --

Column 8, after the equation on line 60, insert the following:

-- where εr = permittivity of the line; and
λ = wavelength. --

Signed and Sealed this

Sixth Day of May, 2008

JON W. DUDAS
*Director of the United States Patent and Trademark Office*